US006419348B1

(12) United States Patent
Kojima et al.

(10) Patent No.: US 6,419,348 B1
(45) Date of Patent: Jul. 16, 2002

(54) INK EJECTING DEVICE AND PIEZOELECTRIC ELEMENT THEREOF

(75) Inventors: Masatomo Kojima, Ichinomiya; Yoshiyuki Ikezaki, Nagoya, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/409,383

(22) Filed: Sep. 30, 1999

(30) Foreign Application Priority Data

Oct. 22, 1998 (JP) ..... 10-301350

(51) Int. Cl.[7] ..... B41J 2/045
(52) U.S. Cl. ..... 347/72
(58) Field of Search ..... 347/68–72; 310/312, 310/366, 332

(56) References Cited

U.S. PATENT DOCUMENTS 4,366,490 A * 12/1982 DeBonte et al. ..... 347/68
6,174,051 B1 * 1/2001 Sakaida ..... 347/72

FOREIGN PATENT DOCUMENTS

JP 10-058674 A * 3/1998 ..... B41J/2/045

* cited by examiner

*Primary Examiner*—Judy Nguyen
(74) *Attorney, Agent, or Firm*—Oliff & Berridge, PLC

(57) ABSTRACT

An ink ejecting device in accordance with the invention regulates the ink ejecting velocity for each nozzle. A piezoelectric element thereof is made of piezoelectric materials, internal discrete electrodes and a common electrode. When a cut in the common electrode is formed above an ink chamber, the cut creates an area where an electric field is not generated. The extent of deformation of the piezoelectric element is reduced in that area, whereby the ink ejecting velocity from the ink chamber decreases. In this way, it is possible to regulate the ink ejecting velocity for each nozzle by providing the cut and adjusting the extent of deformation. Further, the size of the cut is in proportion to the deceleration of ink ejecting velocity. This cut in the common electrode is created exactly above the center of the ink chamber so that the deforming portion and non-deforming portion of the piezoelectric element are well balanced.

19 Claims, 5 Drawing Sheets

INK EJECTING DEVICE AND PIEZOELECTRIC ELEMENT THEREOF

BACKGROUND OF THE INVENTION

1. Field of the Invention

The present invention relates to an ink ejecting device of an ink-jet printer, and in particular relates to a piezoelectric element of the ink ejecting device.

2. Description of Related Arts

A conventional ink ejecting device of an ink-jet printer includes a ceramic cavity plate that includes ink chambers, which are divided by separation walls, and a piezoelectric element attached to the cavity plate. In such an ink ejecting device, the piezoelectric element induces a pressure change within the ink chambers, which forces the ejection of ink from the ink chambers through nozzles provided on the cavity plate.

Various kinds of piezoelectric elements have been applied to the conventional ink ejecting device; one of which is a laminated piezoelectric element. This type of piezoelectric element has a layer structure of sheet-shaped piezoelectric materials, on which positive and negative electrode patterns are alternately created at regular intervals by screen process printing. Multiple grooves are formed on the piezoelectric element so as to detach deforming portions respectively after the removal of a binder and the sintering process. Each deforming portion is positioned above one of the ink chambers, whereby the piezoelectric element appropriately forces the ejection of ink from each ink chamber.

However, the piezoelectric element shrinks during the sintering process. This shrinkage often causes slippage of the layer structure or uneven intervals between the electrode patterns. As a result, the ink ejecting performance varies from nozzle to nozzle even in the same ink ejecting device, since the ability to distort a piezoelectric element is not uniform. Conventionally, the voltage or the waveform of signals supplied to the piezoelectric element is adjusted on each nozzle in order to regulate the ink ejecting performance, although this complicates the control of such an ink ejecting device.

SUMMARY OF THE INVENTION

In order to solve the problem mentioned above, the object of the invention is therefore to provide an ink ejecting device which has a uniform ink ejecting performance for each nozzle without intricate control thereof. The ink ejecting device of the invention comprises ink chambers, provided at regular intervals on a cavity plate, that store ink, and a piezoelectric element attached to the cavity plate. A pressure change is caused within the ink chamber by the piezoelectric element in this ink ejecting device, thereby, forcing the ejection of ink through nozzles.

According to the invention, the piezoelectric element is made of: piezoelectric materials; discrete electrodes provided above the ink chamber or above a separation wall on each of the piezoelectric materials; and an electrode, common to all the ink chambers, that operates as an outer layer covering the outside of the piezoelectric materials. Particularly, the piezoelectric element defines a cut in the common electrode to equalize the ink ejecting velocity of each nozzle.

With this arrangement, the cut in the common electrode creates an area where an electric field is not induced in the piezoelectric element, when applying a voltage to the electrodes. The extent of deformation of the piezoelectric element is reduced in this area, which decreases the ink ejecting velocity. In other words, it is possible to regulate the ink ejecting performance by providing the cut, thereby, adjusting the extent of deformation so that the ink ejecting velocity is equalized on each nozzle. This guarantees good image forming performance, even if the piezoelectric element shrinks during the sintering process.

Further, the cut in the common electrode is provided above the center of the ink chamber so that the deforming portion and the non-deforming portion of the piezoelectric element are well balanced. The ink ejecting velocity is appropriately regulated in this configuration.

Still further, the size of the cut is in proportion to the deceleration of the ink ejecting velocity. The size of the cut can be immediately determined when measuring the ink ejecting velocity, which realizes the prompt adjustment of ink ejecting performance.

In the aforementioned configuration, the common electrode may preferably cause the piezoelectric element to deform in unimorph mode. In this case, the common electrode is provided so as to cover the outer surface of the piezoelectric materials and to be exposed to the exterior. Therefore, it is easy to create the cut on the common electrode, and therefore at the same time, easy to adjust the ink ejecting velocity. Alternately, the common electrode may preferably cause the piezoelectric element to deform in bimorph mode. The extent of deformation in unimorph mode or in bimorph mode can be adjusted by providing the cut on the common electrode. As noted above, the cut in the common electrode creates the area where an electric field is not induced. The extent of deformation is reduced in total, because the deformation in both of unimorph mode and bimorph mode does not occur in this area. This phenomenon is utilized to regulate the ink ejecting velocity, according to the invention.

Another aspect of the invention is to provide a piezoelectric element for the aforementioned ink ejecting device that has a uniform ink ejecting performance. Again, the piezoelectric element is made of: piezoelectric materials; discrete electrodes that provide multiple deforming portions on the piezoelectric materials; and an electrode common to all the deforming portions, covering the outer surface of the piezoelectric materials so as to be exposed to the exterior. The piezoelectric element also defines the cut in the common electrode that is provided to equalize the extent of deformation. The cut creates the area where an electric field is not induced in the piezoelectric element, thereby not causing deformation partially. It is thus possible to regulate the extent of deformation by providing the cut in the common electrode.

BRIEF DESCRIPTION OF THE DRAWINGS

The present invention may be better understood, and its numerous objects, features and advantages will be apparent to those skilled in the art by reference to the accompanying drawings, in which.

DETAILED DESCRIPTION OF PREFERRED EMBODIMENTS

Hereinafter, the present invention will be explained in detail with reference to the accompanying drawings in which specific embodiments are shown by way of illustrative examples.

[First Embodiment]

The first embodiment of the invention will be explained referring to FIGS. 1 to 4.

Figure 2:
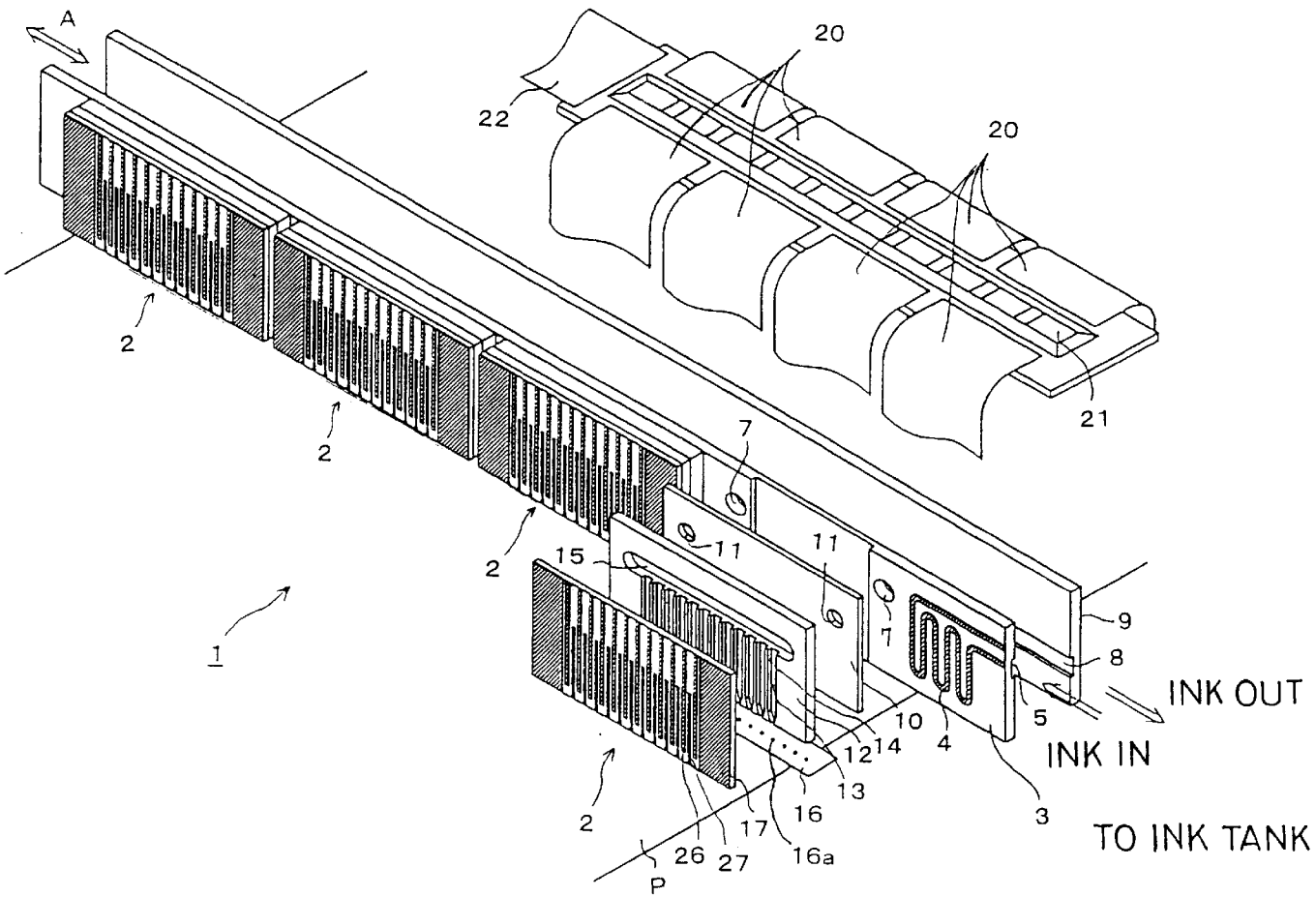
FIG. 2 is an exploded perspective view of a line-type ink ejecting device which includes the ink-jet printhead of FIG. 1.

First, an ink ejecting device 1 according to the first embodiment will be described with reference to FIG. 2. FIG. 2 is an exploded perspective view of a line-type ink ejecting device 1.

As shown in FIG. 2, multiple piezoelectric ink-jet printheads 2 are provided side by side on the front surface of an ink flow plate 3. The ink flow plate 3 is made of an aluminum or a magnesium plate. A heater 4, which is made of patterned stainless steel on a polyimide film, is also attached to the front surface of the ink flow plate 3. On the rear surface of the ink flow plate 3, an inlet 5 for ink is formed to supply ink from an ink storage tank (not shown). Further, ink supply holes 7 are formed through the ink flow plate 3 so as to connect to the inlet 5. The ink from the inlet 5 is supplied to the front surface of the ink flow plate 3 through these ink supply holes 7. An ink flow plate 9 is adhered to the rear surface of the ink flow plate 3. The ink flow plate 9 is also made of an aluminum or a magnesium plate. An outlet 8 to return ink to the ink storage tank is formed on the surface of the ink flow plate 9 opposed to the ink flow plate 3.

The piezoelectric ink-jet printhead 2 includes a base plate 10, a cavity plate 12, a nozzle plate 16 and a piezoelectric element 17.

The base plate 10 is also made of an aluminum or a magnesium plate, on which connecting holes 11 are formed so as to connect to the ink supply holes 7 on the ink flow plate 3. The rear surface of the base plate 10 is bonded to the front surface of the ink flow plate 3 with an adhesive.

The cavity plate 12, made of sintered ceramics, is bonded to the front surface of the base plate 10 with an adhesive. The cavity plate 12 has multiple ink chambers 13 that are open (to the front in FIG. 2), and separation walls 14 that divide each chamber separately. An ink reservoir 15 is also formed on the cavity plate 12 so as to connect to all the ink chambers 13 and to the connecting holes 11.

The nozzle plate 16 is made of a polyimide sheet, and has multiple nozzles 16*a* formed therethrough. Each of the ink chambers 13 gradually becomes narrow toward the end opposite to the ink reservoir 15, and has an opening portion at the end surface of the cavity plate 12. The nozzle plate 16 is bonded to the cavity plate 12 with an adhesive so that the opening portions and the nozzles 16*a* are connected to one another.

The piezoelectric element 17 is further bonded to the cavity plate 12 so as to cover the openings of the ink chambers 13. This piezoelectric element 17 is formed of piezoelectric ceramic layers made of lead zirconate titanate (PZT) material having a piezoelectric effect. On each layer of the piezoelectric ceramics, internal negative electrodes 26 and internal positive electrodes 27 are discretely created with, for example, a mixture of silver and palladium by screen process printing, although the electrode patterns are partly omitted from FIG. 2 in order to simplify the drawing. A common electrode is provided so as to cover the surface of the piezoelectric element 17.

The electrodes 26 and 27, and the common electrode 28 (see FIGS. 1, 3 and 4) are connected to a power source (not shown). This power source is further connected to a drive IC 21 through flexible printed boards 20. The drive IC 21 is connected to a main board (not shown) including a CPU through the flexible printed boards 20. The drive IC 21 is driven in correspondence with the signal from the main board, and then, supplies the signal to the electrodes 26 and 27. The piezoelectric ceramic layers distort corresponding to the signal, which causes a pressure change within the ink chamber 13. Based on this pressure change, ink is ejected from the ink chambers 13 through the nozzles 16*a* provided on the nozzle plate 16.

Such ejection of ink is performed by each piezoelectric ink-jet printhead 2 simultaneously, while the ink ejecting device 1 is moved in direction "A". Thus, printing is performed at high speed on a sheet of paper P by line.

Figure 1:
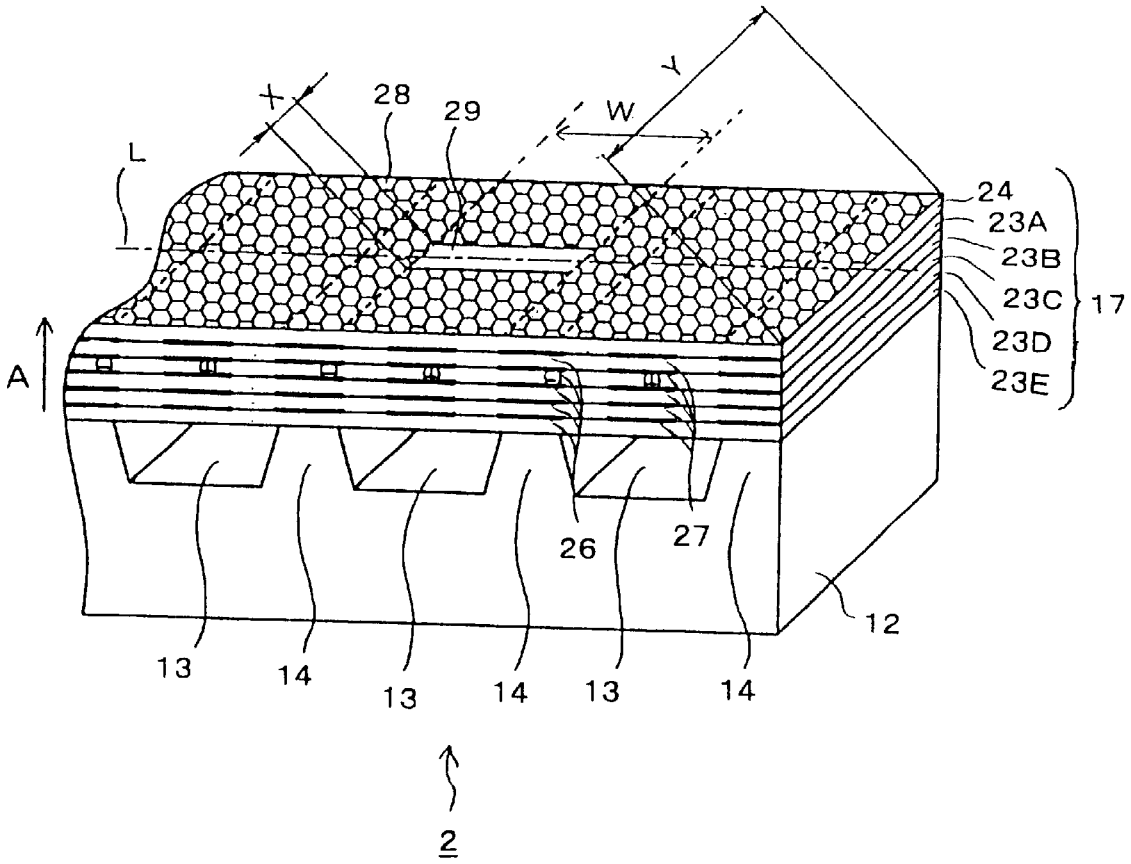
FIG. 1 is a sectional view of an ink-jet printhead according to the first embodiment of the invention.

Next, the structure of the piezoelectric element 17 utilized for the ink-jet printhead 2 will be described in detail with reference to FIG. 1.

The piezoelectric element 17 includes multiple piezoelectric ceramic layers (for example, six piezoelectric ceramic layers in FIG. 1) made of a ceramic material, such as lead zirconate titanate (PZT), having a piezoelectric effect. For a general understanding of the first embodiment, the piezoelectric ceramic layers are herein referred to as an exterior piezoelectric ceramic layer 24, and piezoelectric ceramic layers 23A to 23E, as shown in FIG. 1.

Each of the piezoelectric ceramic layers 23A to 23E includes the internal electrodes 27 above each of the ink chambers 13, and the internal electrodes 26 above the separation walls 14. No electrodes are provided on the surface of the piezoelectric ceramic layer 23E facing ink in the ink chambers 13. In this configuration, the piezoelectric ceramic layer 23E functions as an insulating layer, thereby, preventing ink from reaching the internal electrodes 27 on the piezoelectric ceramic layer 23D. Consequently, it is possible to separate ink in the ink chamber 13 from the electrodes on the piezoelectric ceramic layers, without providing an insulating layer (such as an insulating film) or an oscillating plate specially. As shown in FIG. 1, the internal electrodes 26 and 26 are created on the piezoelectric ceramic layers 23A to 23E alternately at regular intervals. Each of the internal electrodes 27 is connected to a positive terminal of a power source (not shown) through a switch (not shown). Each of the internal electrodes 26 is grounded. The common electrode 28 is provided so as to cover the exterior piezoelectric ceramic layer 24 and to be exposed to the exterior. Further, the common electrode 28 is also grounded. In FIG. 1, a cut 29 in the common electrode is formed above the second ink chamber 13 from the right, by way of example.

The laminated piezoelectric element 17 having such a structure is polarized in direction "A" from the piezoelectric ceramic layer 23E toward the piezoelectric ceramic layer 24.

Figure 4:
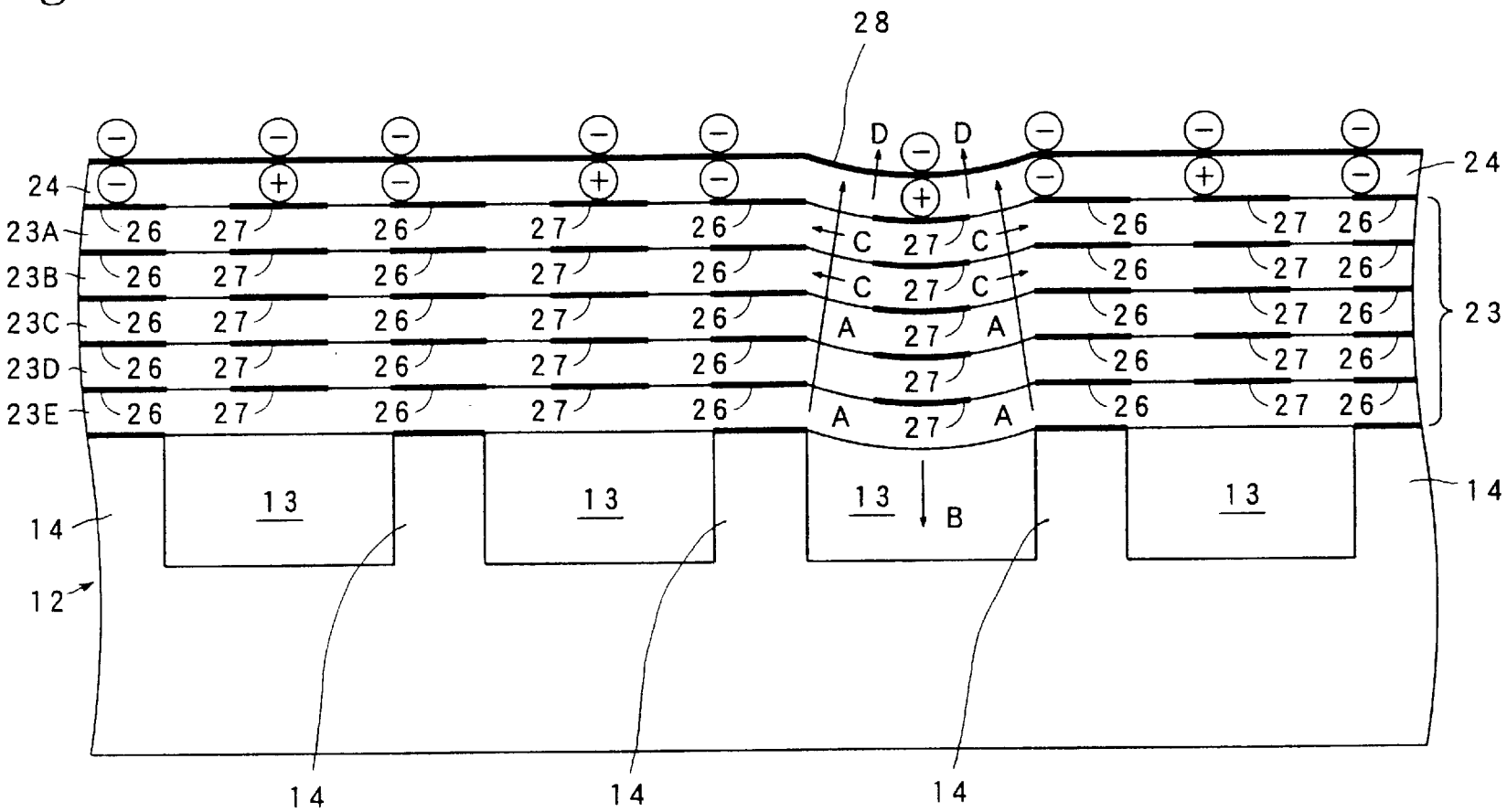
FIG. 4 schematically shows the performance of the ink-jet printhead of FIG. 1.

Now, the operation of the ink-jet printhead 2 having the above-described piezoelectric element 17 will be described with reference to FIG. 4. FIG. 4 is a sectional view of the ink-jet printhead 2 of FIG. 1 for the purpose of explaining its operation, and assumes that the switch for the second ink chamber 13 from the right is turned on.

When the switch (not shown) is turned on through a controller (not shown) based on printing data, a voltage is supplied from the power source (not shown) to the internal electrodes 27 above the second ink chamber 13 from the right. An electric field is induced between the internal electrodes 27 and 26 in direction "C", which is perpendicular to the direction "A" of polarization of the piezoelectric ceramic layers 23A to 23E. Thus, the piezoelectric ceramic layers 23A to 23E undergo shear deformation as shown in FIG. 4. At the same time, the exterior piezoelectric ceramic layer 24 is affected by an electric field generated between the internal electrodes 27 and the common electrode 28 in direction "D", which is parallel to the direction "A" of polarization. Thus, the piezoelectric ceramic layer 24 undergoes unimorph deformation. The piezoelectric element 17 distorts largely due to shear deformation and unimorph deformation, whereby the ink chamber 13 is compressed. This distortion of the ink chamber 13 causes the ejection of ink from the second ink chamber 13 from the right through the nozzle 16*a* (shown in FIG. 2) toward a sheet of paper P.

Herein, the piezoelectric element deforms in shear mode, when an electric field is generated in the direction perpendicular to the polarization direction thereof. In other words, the piezoelectric element shears in the direction parallel to the polarization direction, being affected by the electric field.

Further, the piezoelectric element deforms in unimorph mode, when an elastic material is attached to one side of the polarized piezoelectric element so as to cross an electric field generated in the direction parallel to the polarization direction. The piezoelectric element stretches in its in-plane direction, while the elastic material serves to restrain the piezoelectric element.

In the present embodiment, the piezoelectric ceramic layer 23A functions as an elastic material. When a voltage is applied to the internal electrode 27 and the common electrode 28 is grounded, an electric field is induced on the exterior piezoelectric ceramic layer 24 in the direction parallel to polarization. The exterior piezoelectric layer 24 stretches in its out-of-plane direction, and at the same time, contracts in its in-plane direction. Since the piezoelectric layer 23A restrains this contraction, the piezoelectric ceramic layer 24 distorts in direction "B" shown in FIG. 4. This causes the piezoelectric layers 23A to 23E, which have deformed in shear mode, to further deform.

The extent of unimorph deformation of the exterior piezoelectric ceramic layer 24 is in proportion to the electric field generated thereon. As shown in FIG. 1, in the case of forming the cut 29 on the common electrode 28, this cut 29 creates the area where an electric field is not induced on the exterior piezoelectric layer 24. The extent of unimorph deformation decreases due to the cut 29, since unimorph deformation does not occur in that area. This leads the piezoelectric element above the second ink chamber from the right to deform less, whereby the ink ejecting velocity therefrom is reduced.

Figure 3:
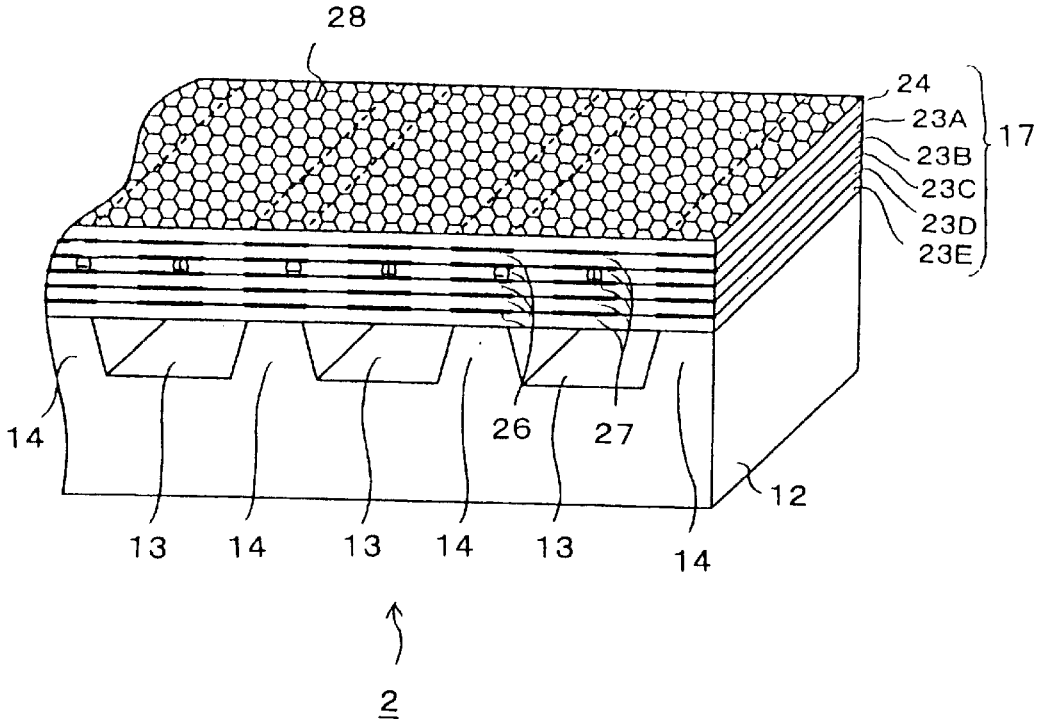
FIG. 3 is a sectional view of the ink-jet printhead of FIG. 1, wherein a cut has not formed on a common electrode.

According to present embodiment, the ink ejecting velocity is measured once before forming the cut 29 in the common electrode as shown in FIG. 3. If the velocity differs on each nozzle, the cut 29 is formed, and its size is determined so as to adjust the ink ejecting velocity. For example, if the piezoelectric elements do not shrink proportionally during the sintering process, the internal electrodes 27 are not positioned exactly above the ink chamber due to various pitches between the electrodes. Assuming the ink ejecting velocity from one ink chamber is faster by 10% than the average velocity, the cut 29 is formed so as to cover 5% of the area of the common electrode 28 above that ink chamber. (This area is defined as the width W by the length X in FIG. 1.) As the extent of deformation in this area is reduced, the ink ejecting velocity from that ink chamber is equalized to the average velocity. The relationship between the deceleration of ink ejecting velocity and the size of the cut 29 should be determined in advance on an experimental basis.

Further, the cut 29 on the common electrode 28 is formed so as to extend in plus and minus Y directions from a central line L in the longitudinal direction of the common electrode 28. Forming the cut 29 in this way, the deforming portion and the non-deforming portion of the piezoelectric element 17 can be well balanced to adjust the ink ejecting velocity appropriately.

Furthermore, the cut 29 in the common electrode 28 is preferably formed by, for example, an end mill or an electric discharge machine.

[Second Embodiment]

Next, the second embodiment of the present invention will be explained with reference to FIG. 5.

Figure 5:
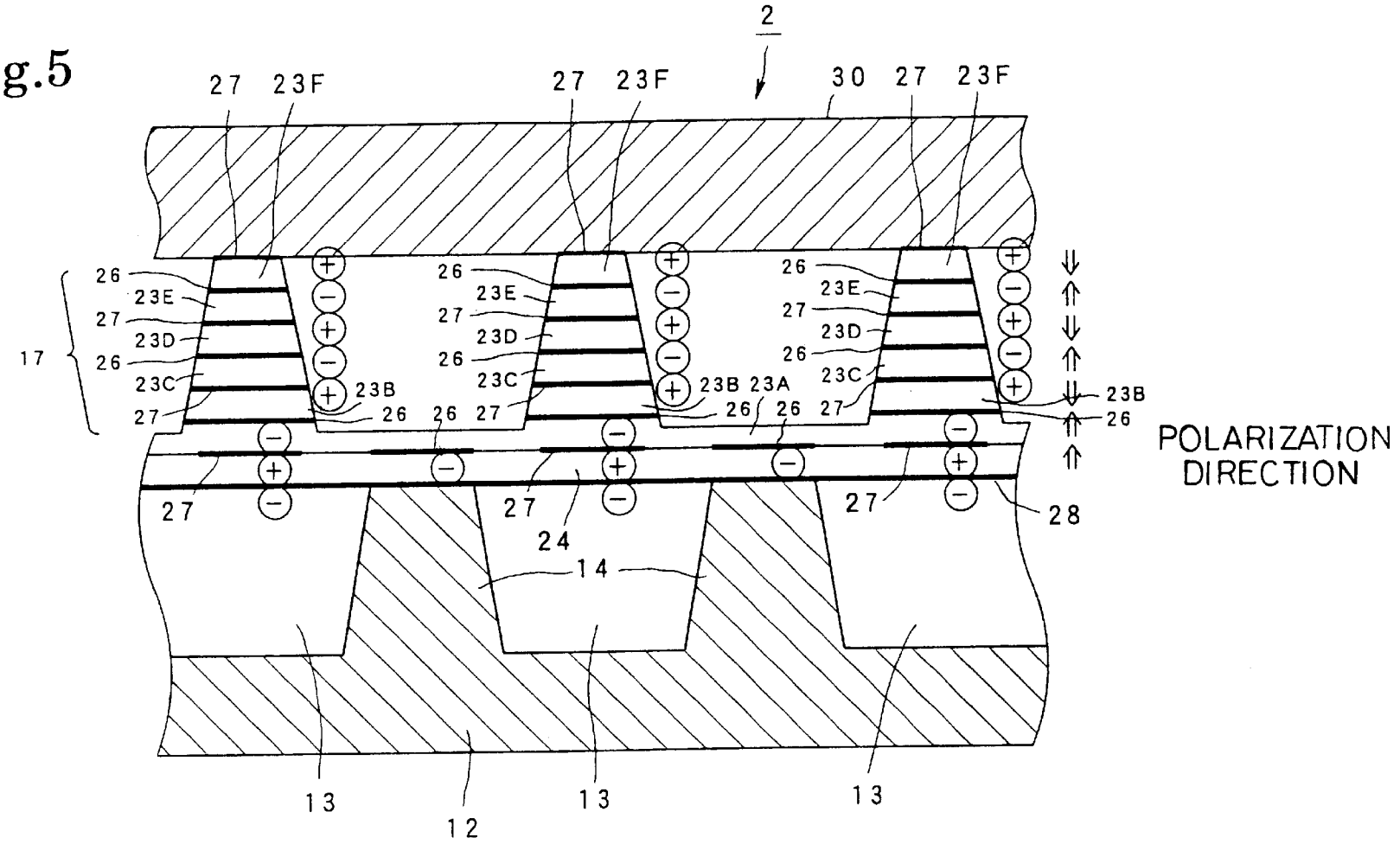
FIG. 5 is a sectional view of an ink-jet printhead according to the second embodiment of the invention.

FIG. 5 is a sectional view of another type of ink-jet printhead 2 according to the second embodiment. The ink-jet printhead 2 of the second embodiment includes a piezoelectric element 17 that undergoes deformation in stretching mode as well as in bimorph mode. A common electrode 28 is provided so as to face to a cavity plate 12.

The piezoelectric element 17 is formed of an exterior piezoelectric ceramic layer 24 and piezoelectric ceramic layers 23A to 23F, forming a seven-layer structure. Internal electrodes 27 and 26 are created on the piezoelectric ceramic layers 24 and 23A to 23F so as to lie one upon another above ink chambers 13. The internal electrodes 26 are also created above separation walls 14 between the piezoelectric ceramic layers 24 and 23A. Further, a restraint layer 30 is provided, covering the piezoelectric ceramic layer 23F and the internal electrodes 27.

The exterior piezoelectric ceramic layer 24 and the piezoelectric ceramic layer 23A are polarized in direction from the cavity plate 12 toward the restraint layer 30. On the other hand, the piezoelectric ceramic layers 23B to 23F are polarized in direction opposite to the adjacent one, as shown in FIG. 5.

In this configuration, when a voltage is applied to the internal electrodes 27 and the internal electrodes 26, and the common electrode 28 is grounded, the piezoelectric ceramic layers 23A to 23F deform in stretching mode, and at the same time, the exterior piezoelectric ceramic layer 24 and the piezoelectric ceramic layer 23A deform in bimorph mode.

Herein, the piezoelectric element deforms in stretching mode, when an electric field is generated thereon in the direction parallel to the polarization direction. The piezoelectric element stretches in the direction parallel to the polarization direction. In the present embodiment, the piezoelectric ceramic layers 23A to 23F stretch vertically. However, the restraint layer 30 restrains the piezoelectric ceramic layer 23F to stretch upwardly. Thus, the piezoelectric ceramic layers cumulatively 23A to 23F deform downward.

Further, the piezoelectric elements polarized in the same direction deform in bimorph mode, when an electric field is induced on the two layers thereof. Specifically, the electric field is induced on one of the two piezoelectric layers in the direction opposite to the polarization direction, and at the same time, the electric field is induced on the other piezoelectric layer in the same direction as the polarization direction. In this case, the former piezoelectric element contracts in its in-plane direction, while the latter stretches in its in-plane direction, whereby the piezoelectric elements bend. In the present embodiment, an electric field is generated on the exterior piezoelectric ceramic layer 24 in the direction opposite to the polarization direction, and an electric field is generated on the piezoelectric ceramic layer 23A in the same direction as the polarization direction. Thus, the piezoelectric ceramic layers 24 and 23A deform in bimorph mode.

As described above, the piezoelectric element 17 according to the present embodiment deforms in stretching mode as well as in bimorph mode, thereby, forcing the ink chambers 13 to distort a large amount. It is also possible to adjust the extent of deformation in bimorph mode of the piezoelectric element 17 by providing a cut 29 (not shown in FIG. 5) on the common electrode 28 to regulate the ink ejecting velocity.

However, the cut 29 cannot be created after completing the ink-jet head 2, since the common electrode 28 and the cavity plate 12 are bonded to one another with an adhesive. Therefore, multiple piezoelectric elements 17 are simultaneously manufactured in the same condition. One of the piezoelectric elements 17 is experimentally formed in the ink-jet printhead 2, wherein the ink ejecting velocity is measured on each nozzle in order to estimate the size of the cut 29. The cuts 29 are created on the common electrode 28 of the other piezoelectric elements 17 based on the estimation. After that, the piezoelectric elements 17 are bonded to the cavity plates 12, and formed in the ink-jet printheads 2. Since the other piezoelectric elements 17 are assumed to have the same characteristic, the ink ejecting velocity is equalized according to the present embodiment.

The present invention is not limited to the structure of the above-mentioned embodiments in which the laminated piezoelectric element is applied to the ink-jet printhead, and various modifications thereof are possible. For example, the present invention may be applied to a monolayer piezoelectric element. In this case, a cut is created on a discrete electrode, since a common electrode is not provided in the piezoelectric element.

What is claimed is:

1. An ink ejecting device, comprising:

nozzles;

a cavity plate defining ink chambers that are provided at regular intervals and separated by separation walls;

a piezoelectric element attached to the cavity plate so as to cover all of the ink chambers, the piezoelectric element able to cause a pressure change in the ink chambers so as to eject ink from the ink chambers through the nozzles, the piezoelectric element including multiple piezoelectric layers;

discrete electrodes that are provided on at least one of the piezoelectric layers above at least one of the ink chambers and the separation walls; and a common electrode that is common to all of the ink chambers, the common electrode covering a surface of one of the piezoelectric layers, the common electrode defining at least one cut so as to adjust the ink ejecting velocity for at least one nozzle.

2. The ink ejecting device according to claim 1, wherein said at least one cut defined by the common electrode is provided above a center of at least one ink chamber.

3. The ink ejecting device according to claim 1, wherein the at least one cut has a size that is in proportion to a deceleration of the ink ejecting velocity.

4. The ink ejecting device according to claim 1, wherein the layer having said common electrode undergoes deformation in unimorph mode.

5. The ink ejecting device according to claim 1, wherein the surface is on the exterior side of the piezoelectric layers so as to be exposed to the exterior.

6. The ink ejecting device according to claim 1, wherein the layer having said common electrode and the layer immediately adjacent to the layer having the common electrode undergo deformation in bimorph mode.

7. A piezoelectric element, comprising:

piezoelectric layers having multiple deformable portions;

discrete electrodes provided on at least one of said piezoelectric layers so as to deform the deformable portions; and a common electrode that is common to all of the deformable portions, the common electrode covering a surface of one of said piezoelectric layers, the common electrode defining at least one cut that enables the extent of deformation in at least one deformable portion to be equalized.

8. A method of manufacturing an ink ejecting device, comprising the steps of:

placing ink chambers in a cavity plate at regular intervals that are separated by separation walls;

attaching a piezoelectric element to the cavity plate so that the piezoelectric element covers all of the ink chamber and is able to cause a pressure change in the ink chambers, the piezoelectric element including multiple piezoelectric layers;

providing discrete electrodes on at least one of the piezoelectric layers above at least one of the ink chambers and separation walls;

covering a surface of one of the piezoelectric layers with a common electrode that is common to all of the ink chambers; and defining at least one cut in the common electrode so as to enable the adjustment of ink ejecting velocity from at least one ink chamber.

9. The method according to claim 8, wherein the defining step includes defining at least one cut in the common electrode above a center of the at least one ink chamber.

10. The method according to claim 8, wherein the defining step includes defining at least one cut in the common electrode that has a size in proportion to a deceleration of the ink ejecting velocity.

11. The method according to claim 8, wherein the layer having the common electrode undergoes deformation in unimorph mode.

12. The method according to claim 8, wherein the common electrode is exposed to the exterior.

13. The method according to claim 8, wherein the layer having the common electrode and the layer immediately adjacent to the layer having the common electrode undergo deformation in bimorph mode.

14. The method according to claim 8, wherein the defining step includes defining at least one cut that equalizes the extent of deformation of the piezoelectric layers.

15. The method according to claim 8, wherein the defining step includes defining at least one cut that creates an area where an electric field is not induced in the piezoelectric layers.

16. The piezoelectric element according to claim 7, wherein the layer having the common electrode undergoes deformation in unimorph mode.

17. The piezoelectric element according to claim 7, wherein the layer having the common electrode and the layer immediately adjacent to the layer having the common electrode undergo deformation in bimorph mode.

18. The piezoelectric element according to claim 7, wherein the at least one cut defined by the common electrode creates an area where an electric field is not induced in the piezoelectric layers.

19. The piezoelectric element according to claim 7, wherein the surface is on the exterior side of the piezoelectric layers so that the common electrode is exposed by the exterior.

* * * * *